US010881132B2

(12) United States Patent
Mua et al.

(10) Patent No.: US 10,881,132 B2
(45) Date of Patent: Jan. 5, 2021

(54) SMOKELESS TOBACCO PRODUCT COMPRISING EFFERVESCENT COMPOSITION

(75) Inventors: John-Paul Mua, Advance, NC (US); Eric Taylor Hunt, Pfafftown, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1650 days.

(21) Appl. No.: 13/325,765

(22) Filed: Dec. 14, 2011

(65) Prior Publication Data

US 2013/0152953 A1 Jun. 20, 2013

(51) Int. Cl.
*A24B 13/00* (2006.01)
*A24B 15/18* (2006.01)

(52) U.S. Cl.
CPC ..... *A24B 15/18* (2013.01); *A24B 13/00* (2013.01)

(58) Field of Classification Search
CPC ..... A24B 15/18; A24B 13/00; A61K 9/0007; A61K 9/2009; A61K 9/2077; A61K 9/2086
USPC ..... 131/352
See application file for complete search history.

(56) References Cited

U.S. PATENT DOCUMENTS

| | | | | |
|---|---|---|---|---|
| 1,376,586 | A | 5/1921 | Schwartz | |
| 3,696,917 | A | 10/1972 | Levi | |
| 4,241,092 | A * | 12/1980 | Halik et al. | 426/96 |
| 4,289,794 | A | 9/1981 | Kleiner et al. | |
| 4,513,756 | A | 4/1985 | Pittman et al. | |
| 4,528,993 | A | 7/1985 | Sensabaugh, Jr. et al. | |
| 4,624,269 | A | 11/1986 | Story et al. | |
| 4,639,368 | A | 1/1987 | Niazi et al. | |
| 4,987,907 | A | 1/1991 | Townend | |
| 4,991,599 | A | 2/1991 | Tibbetts | |
| 5,092,352 | A | 3/1992 | Sprinkle, III et al. | |
| 5,165,951 | A | 11/1992 | Gallart et al. | |
| 5,178,878 | A | 1/1993 | Wehling et al. | |
| 5,223,264 | A | 6/1993 | Wehling et al. | |
| 5,387,416 | A | 2/1995 | White et al. | |
| 5,439,698 | A | 8/1995 | Ahn et al. | |
| 6,235,318 | B1 | 5/2001 | Lombardy, Jr. et al. | |
| 6,668,839 | B2 | 12/2003 | Williams | |
| 6,834,654 | B2 | 12/2004 | Williams | |
| 6,953,040 | B2 | 10/2005 | Atchley et al. | |
| 6,953,592 | B2 * | 10/2005 | Darbyshire et al. | 424/489 |
| 6,974,590 | B2 | 12/2005 | Pather et al. | |
| 7,032,601 | B2 | 4/2006 | Atchley et al. | |
| 7,381,667 | B2 | 6/2008 | Bergquist et al. | |
| 7,694,686 | B2 | 4/2010 | Atchley et al. | |
| 2001/0048965 | A1 * | 12/2001 | Cherukuri | 426/660 |
| 2002/0162562 | A1 * | 11/2002 | Williams | 131/352 |
| 2004/0020503 | A1 | 2/2004 | Williams | |
| 2005/0074489 | A1 * | 4/2005 | Gonzales et al. | A61K 9/0007 424/466 |
| 2005/0115580 | A1 | 6/2005 | Quinter et al. | |
| 2005/0244521 | A1 | 11/2005 | Strickland et al. | |
| 2006/0078508 | A1 | 4/2006 | Gebreselassie et al. | |
| 2006/0191548 | A1 * | 8/2006 | Strickland et al. | 131/347 |
| 2007/0062549 | A1 | 3/2007 | Holton, Jr. et al. | |
| 2007/0186941 | A1 | 8/2007 | Holton, Jr. et al. | |
| 2007/0186942 | A1 | 8/2007 | Strickland et al. | |
| 2007/0190157 | A1 * | 8/2007 | Sanghvi et al. | A23G 3/56 424/489 |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0209586 | A1 | 8/2008 | Nielsen et al. | |
| 2008/0305216 | A1 | 12/2008 | Crawford et al. | |
| 2009/0025741 | A1 | 1/2009 | Crawford et al. | |
| 2009/0065013 | A1 | 3/2009 | Essen et al. | |
| 2009/0214442 | A1 * | 8/2009 | Agarwal et al. | 424/43 |
| 2009/0293889 | A1 | 12/2009 | Kumar et al. | |
| 2010/0018539 | A1 | 1/2010 | Brinkley et al. | |
| 2010/0170522 | A1 | 7/2010 | Sun et al. | |
| 2011/0014132 | A1 | 1/2011 | Liu | |
| 2011/0070286 | A1 * | 3/2011 | Hugerth et al. | 424/440 |

FOREIGN PATENT DOCUMENTS

| | | | |
|---|---|---|---|
| WO | WO 97/06786 | A1 | 2/1997 |
| WO | WO 2004/095959 | A1 | 11/2004 |
| WO | WO 2006/065239 | | 6/2006 |
| WO | WO 2009/143845 | A2 | 12/2009 |

* cited by examiner

*Primary Examiner* — Michael H. Wilson
*Assistant Examiner* — Dionne W. Mayes
(74) *Attorney, Agent, or Firm* — Womble Bond Dickinson (US) LLP

(57) ABSTRACT

The invention provides a smokeless tobacco composition adapted for oral use, the composition including a tobacco material and an effervescent material. The effervescent material includes a sugar material containing an entrapped gaseous component, such that release of the entrapped gaseous component occurs upon dissolution of the sugar material in the oral cavity. The invention also provides a method for making a smokeless tobacco composition that involves mixing a tobacco material with an effervescent material, the mixing step including either admixing a granulated composition comprising a tobacco material with a gasified sugar material in particulate form, or forming a gasified sugar material in situ by mixing a water source with a molten composition comprising a tobacco material and a sugar alcohol.

10 Claims, 1 Drawing Sheet

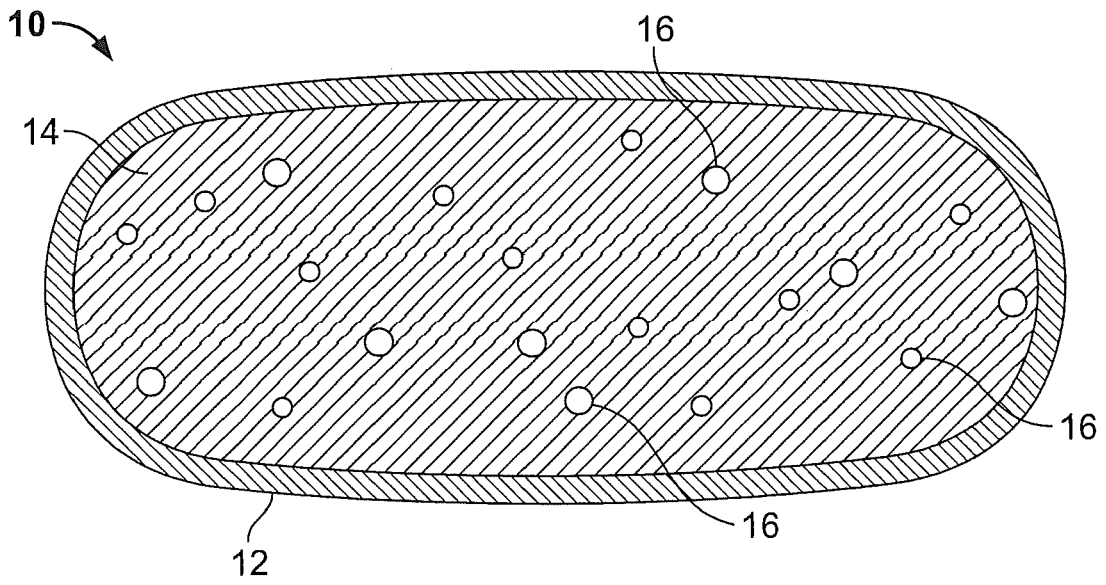
10
16
14
16
16
12

SMOKELESS TOBACCO PRODUCT COMPRISING EFFERVESCENT COMPOSITION

FIELD OF THE INVENTION

The present invention relates to products made or derived from tobacco, or that otherwise incorporate tobacco, and are intended for human consumption. In particular, the invention relates to smokeless tobacco products containing ingredients or components obtained or derived from plants of the *Nicotiana* species.

BACKGROUND OF THE INVENTION

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; 2010/0291245 to Gao et al; and 2011/0139164 to Mua et al.; PCT WO 04/095959 to Arnarp et al. and WO 2010/132444 to Atchley; each of which is incorporated herein by reference. Exemplary smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

It would be desirable to provide an enjoyable form of a tobacco product, such as a smokeless tobacco product, and to provide processes for preparing tobacco-containing compositions suitable for use in smokeless tobacco products.

SUMMARY OF THE INVENTION

The present invention relates to a tobacco product, most preferably a smokeless tobacco product intended or configured for insertion into the mouth of a user, and to processes for preparing a formulation suitable for use within such a smokeless tobacco product. The present invention relates to tobacco products, and in particular, smokeless tobacco products, that incorporate materials from *Nicotiana* species (e.g., tobacco-derived materials) and an effervescent material. The effervescent material adds distinctive organoleptic properties to the smokeless tobacco product and also aids in disintegration of the tobacco product in the oral cavity. Gasified sugar materials are used to achieve the effervescent effect, and the invention also provides multiple methods for incorporating gasified sugar materials into a tobacco product.

In one aspect, the invention provides a smokeless tobacco composition adapted for introduction into the oral cavity comprising a tobacco material (e.g., a particulate tobacco material or an aqueous tobacco extract or both) and an effervescent material capable of causing effervescence in the oral cavity, the effervescent material comprising a sugar material containing an entrapped gaseous component, such that release of the entrapped gaseous component occurs upon dissolution of the sugar material in the oral cavity. The sugar material is typically a sugar substitute, such as a sugar alcohol, and exemplary sugar alcohols include erythritol, threitol, arabitol, xylitol, ribotol, mannitol, sorbitol, dulcitol, iditol, isomalt, maltitol, lactitol, polyglycitol, and mixtures thereof. Erythritol, isomalt, and mixtures thereof are particularly advantageous sugar alcohols. The smokeless tobacco composition can include various other components, such as salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, lipids, and combinations thereof.

In certain embodiments, the tobacco material in the products of the invention is in the form of a tobacco extract, such as an aqueous tobacco extract, in solid form. The use of a solid tobacco extract, such as in a freeze-dried or spray-dried form, can be useful to avoid introducing sufficient moisture into the products of the invention to prematurely trigger the effervescence reaction.

The smokeless tobacco composition can be prepared in a variety of forms, including particulate, compressed or extruded forms. In some embodiments, the smokeless tobacco composition is formed into a predetermined shape or form, such as particulate, pellet, rod, or film. The smokeless tobacco composition can also include an outer coating, such as a coating designed to prevent premature moisture exposure to the effervescent material.

In one embodiment, the gasified sugar material is present in an amount of about 20 dry weight percent to about 60 dry weight percent, and the tobacco material is present in any amount of about 3 dry weight percent to about 60 dry weight percent, based on the total dry weight of the smokeless tobacco composition. The composition can include further ingredients, such as at least about 3 dry weight percent of at least one filler (e.g., microcrystalline cellulose, mannitol, maltodextrin, and combinations thereof) or at least about 2 dry weight percent of at least one binder (e.g., povidone, concentrated tobacco extracts, maltitol syrup, or combinations thereof).

In embodiments including a sugar alcohol, the tobacco material is typically present in any amount of at least about 5 dry weight percent and the sugar alcohol is typically present in an amount of at least about 50 dry weight percent, based on the total dry weight of the smokeless tobacco composition. The sugar alcohol is optionally combined with at least about 5 dry weight percent of a sugar alcohol syrup (e.g., maltitol syrup). In certain embodiments, the composition further includes a lipid component, such as at least about 5 dry weight percent of a lipid, based on the total weight of the smokeless tobacco composition.

To augment or enhance the effervescing effect of the gasified sugar material, a base or acid component (or combination thereof) can be added to the smokeless tobacco composition of the invention. Exemplary compositions can include at least about 1 dry weight percent of at least one acid and at least about 1 dry weight percent of at least one base. Exemplary acids include triprotic acids, such as citric, tartaric, malic, and lactic acids, and exemplary bases include carbonate materials, bicarbonate materials, and mixtures thereof.

The gasified sugar material can be used in particulate form, such as by admixing gasified sugar particles with a tobacco material (e.g., a granulated tobacco composition). Alternatively, the gasified sugar material can be formed in situ as described hereinbelow.

In another aspect, the invention provides a method of preparing a smokeless tobacco composition adapted for introduction into the oral cavity, the method comprising (i) mixing a tobacco material with an effervescent material capable of causing effervescence in the oral cavity, the effervescent material comprising a sugar material containing an entrapped gaseous component, such that release of the entrapped gaseous component occurs upon dissolution of the sugar material in the oral cavity, wherein the mixing step comprises (a) admixing a granulated composition comprising a tobacco material with a gasified sugar material in particulate form; or (b) forming a gasified sugar material in situ by mixing a water source with a molten composition comprising a tobacco material and a sugar alcohol; and (ii) incorporating the mixture formed in step (i) into a smokeless tobacco product.

The granulated composition can vary, but typically includes a tobacco material, at least one filler, at least one sugar alcohol, and at least one binder. The granulated composition may also include an acid, a base, or a combination thereof. Where the gasified sugar material is formed in situ, the molten composition typically includes one or more of a sugar alcohol syrup, a humectant, and a lipid. The water source is typically at room temperature or below (e.g., about 0 to about 25° C.). The water source can be ice or chilled water at no more than about 15° C. Either the molten composition or the water source (or both) can include an acid, a base, or a combination thereof. In one embodiment, the molten composition comprises an acid and the water source comprises a base.

The manner in which the mixture of gasified sugar material and tobacco material are incorporated into a smokeless tobacco product can vary. The mixture is typically subjected to additional processing, such as one or more of filtration, cooling, drying, pelletizing, grinding or milling, extruding, and the like. In one embodiment, the smokeless tobacco composition is compressed or extruded into a predetermined shape. In another embodiment, the mixture is in a particulate form, and the particles are loaded into one or more pouches.

BRIEF DESCRIPTION OF THE DRAWING

In order to provide an understanding of embodiments of the invention, reference is made to the appended drawing, which is not necessarily drawn to scale, and in which reference numerals refer to components of described exemplary embodiments of the invention. The drawing is exemplary only, and should not be construed as limiting the invention.

FIG. 1 is a cross-sectional view of a smokeless tobacco product embodiment, taken across the width of the product, showing an outer pouch filled with a tobacco material and a gasified sugar material dispersed therein.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The invention provides a smokeless tobacco product suitable for insertion in the oral cavity that includes a tobacco material and an effervescent material. The effervescent material is a gasified sugar material capable of causing effervescence in the oral cavity through release of an entrapped gaseous component upon dissolution of the sugar material. The entrapped gas is typically carbon dioxide, although other gaseous components can be used such as nitrogen, oxygen, and water vapor. A mixture of various gases can also be used. The presence of the effervescent materials aids disintegration of the smokeless tobacco product in the oral cavity, and also adds distinctive organoleptic properties to the product, particularly in terms of taste and mouthfeel. The use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; and U.S. Pat. No. 7,381,667 to Bergquist et al., as well as US Pat. Pub. Nos. 2006/0191548 to Strickland et al.; 2009/0025741 to Crawford et al; 2010/0018539 to Brinkley et al.; and 2010/0170522 to Sun et al.; and PCT WO 97/06786 to Johnson et al., all of which are incorporated by reference herein.

As used herein, "gasified sugar material" refers to a sugar material containing an entrapped gaseous component capable of release upon dissolution of the sugar material in the oral cavity. The gasified sugar material is typically provided in solid form (e.g., granular or particulate form). The average particle size of the gasified sugar material can vary, but is typically about 50 to about 800 microns, more often about 100 to about 600 microns, and most often about 125 to about 500 microns. The gasified sugar material is advantageously maintained in a very dry state to avoid premature effervescence during handling or storage. For example, the gasified sugar material will typically comprise less than about 5% water by weight, less than about 3% water by weight, less than about 2% water by weight, or less than about 1% water by weight.

Commercially available examples of gasified sugar material are sold under the brand name Carbonated Crystals™ by Raven Manufacturing, LLC of Neenah, Wis. Exemplary methods for forming gasified sugar materials are set forth in U.S. Pat. No. 4,289,794 to Kleiner et al.; U.S. Pat. No. 5,165,951 to Gallart et al., and U.S. Pat. No. 5,439,698 to Ahn et al, all of which are incorporated by reference herein. Typical manufacturing processes involve introducing a gaseous component (e.g., carbon dioxide) under pressure (e.g., 50 to 650 psig) to the sugar material while the sugar is in melted form.

The amount of gasified sugar material in the smokeless tobacco compositions of the invention can vary, and will depend in part on the desired organoleptic properties of the product. Typically, the amount of gasified sugar material (including the total weight of sugar materials and entrapped gas) is in the range of about 10 to about 90 dry weight percent, based on the total weight of the smokeless tobacco composition, often about 20 to about 60 dry weight percent, and most often about 30 to about 50 dry weight percent.

The sugar component of the gasified sugar material can be any of a variety of monosaccharides (e.g., glucose, fructose, galactose), disaccharides (e.g., sucrose, lactose, maltose), trisaccharides, or oligosaccharides. Although sucrose or other nutritive sweeteners can be used as the sugar material of the invention, the smokeless tobacco products of the invention can also be prepared as sugar-free products, meaning the gasified sugar material can be characterized as a sugar substitute. "Sugar-free" as used herein is intended to include products having less than about 1/15th sugar by weight, or less than about 1/10th sugar by weight.

The sugar substitute can be any sugarless material (i.e., sucrose-free material) and can be natural or synthetically produced. The sugar substitute used in the invention can be nutritive or non-nutritive. For example, the sugar substitute is commonly a sugar alcohol. Sugar alcohols that may be useful according to the present invention include, but are not limited to, erythritol, threitol, arabitol, xylitol, ribotol, mannitol, sorbitol, dulcitol, iditol, isomalt, maltitol, lactitol, polyglycitol, and mixtures thereof. For example, in certain embodiments, the sugar alcohol is selected from the group consisting of erythritol, sorbitol, isomalt, and mixtures thereof.

In certain embodiments, the sugar substitute is capable of forming a glassy matrix. The formation of a glassy matrix is commonly characterized by a translucent/transparent appearance. Typically, the sugar substitute is substantially non-hygroscopic. Non-hygroscopic materials typically do not absorb, adsorb, and/or retain a significant quantity of moisture from the air. For example, in some embodiments, the sugar substitute exhibits a weight gain of water of less than about 50% upon exposure to conditions of 25° C., 80% relative humidity for two weeks. Typically, the sugar substitute exhibits a weight gain of less than about 30%, less than about 20%, less than about 10%, less than about 5%, less than about 2%, or less than about 1% upon exposure to conditions of 25° C., 80% relative humidity for two weeks. Non-hygroscopic materials can provide the benefit of reducing the tendency of the smokeless tobacco product to tackify upon exposure to humidity.

In certain embodiments, the sugar substitute comprises one or more sugar alcohols. For example, in one embodiment, the sugar substitute is isomalt. Isomalt is a disaccharide that is typically made by enzymatic rearrangement of sucrose into isomaltulose, followed by hydrogenation to give an equimolar composition of 6-O-α-D-glucopyranosido-D-sorbitol (1,6-GPS) and 1-O-α-D-glucopyranosido-D-mannitol-dihydrate (1,1-GPM-dihydrate).

The amount of sugar substitute (e.g., sugar alcohol) in the smokeless tobacco product mixture can vary, but is typically at least about 20%, or at least about 30%, or at least about 40%, or at least about 50% by dry weight of the smokeless tobacco composition. The amount of sugar substitute typically will not exceed about 90%, or will not exceed about 80%, or will not exceed about 70% by dry weight of the smokeless tobacco composition.

The smokeless tobacco product of the present invention can also contain a syrup component, such as a sugar syrup or a sugar alcohol syrup. "Sugar alcohol syrup" as used herein is intended to refer to a thick solution of sugar alcohol in water, e.g., having greater than about 40% solids, preferably having greater than about 50% solids, greater than about 60% solids, greater than about 70% solids, or greater than about 80% solids. Typically, the solid content of the sugar alcohol syrup primarily comprises the named sugar alcohol (i.e., maltitol syrup typically comprises greater than about 80%, greater than about 85%, or greater than about 90% by weight maltitol on a dry basis). Sugar alcohol syrups are generally prepared by heating a solution of the sugar alcohol in water and cooling the mixture to give a viscous composition. The resulting syrup is typically characterized by a relatively high concentration of sugar alcohol and relatively high stability (i.e., the sugar alcohol typically does not crystallize from solution, e.g., at room temperature).

The syrup, e.g., sugar alcohol syrup, desirably is capable of affecting the re-crystallization of a melted sugar substitute. One exemplary sugar alcohol syrup that is particularly useful according to the present invention is maltitol syrup. Other sugar alcohol syrups can be used, including, but not limited to, corn syrup, golden syrup, molasses, xylitol, mannitol, glycerol, erythritol, threitol, arabitol, ribitol, mannitol, sorbitol, dulcitol, iditol, isomalt, lactitol, and polyglycitol syrups. Such sugar alcohol syrups can be prepared or can be obtained from commercial sources. For example, maltitol syrups are commercially available from such suppliers as Corn Products Specialty Ingredients. Although sugar alcohol syrups may be preferred, sugar syrups can, in certain embodiments, be used in place of or in combination with the sugar alcohol syrup. For example, in some embodiments, corn syrup, golden syrup, and/or molasses can be used.

The amount of sugar alcohol syrup added to the smokeless tobacco product mixture is typically that amount required to slow recrystallization of the sugar substitute in melted form. One of skill in the art would understand the need to vary the amount of sugar alcohol syrup depending on the composition of the remaining ingredients to ensure that the recrystallization is sufficiently slow to provide a material with the desired characteristics (e.g., a desired level of translucency/transparency). Accordingly, the amount of sugar alcohol syrup can vary, but typically ranges from about 0.1% to about 15%, often from about 0.5% to about 10%, and more often about 1% to about 7.5% by dry weight of the smokeless tobacco product mixture. In certain embodiments, the amount of sugar alcohol syrup is higher, for example, up to about 2% by weight of the mixture, up to about 5% by weight of the mixture, up to about 10% by weight of the mixture, or up to about 20% by weight of the mixture. In some embodiments, the amount of sugar alcohol syrup is at least about 2.5% by weight or at least about 5% by weight.

In certain embodiments, the smokeless tobacco compositions of the invention can include acid/base pairs that also contribute to the effervescence effect of the product. See, for example, the use of acids and bases in effervescent compositions described in U.S. application Ser. No. 12/876,785 to Hunt et al., filed Sep. 7, 2010, which is incorporated by reference herein. For example, the acid component of the effervescent material can be selected from carboxylic acids or salts thereof having about 2 to about 12 carbon atoms (e.g., C2-C10 or C2-C8 or C2-C6 carboxylic acids), wherein the carboxylic acids are monoprotic or polyprotic (e.g., dicarboxylic acids or tricarboxylic acids). Exemplary organic acids include citric acid, malic acid, tartaric acid, succinic acid, adipic acid, fumaric acid, and combinations thereof. Exemplary acid salts include sodium salts, potassium salts, calcium salts, magnesium salts, dihydrogen phosphate salts, and disodium dihydrogen pyrophosphate salts. The amount of acid in the compositions of the invention can vary, but is typically at least about 1% by dry weight, or at least about 2% by dry weight.

In one embodiment, a combination of acids is utilized where at least one acid is a polyprotic acid, such as a dicarboxylic acid (tartaric acid) or a tricarboxylic acid (e.g., citric acid). Combinations of a dicarboxylic acid and a tricarboxylic acid are also suitable for use in the invention, such as a combination of tartaric acid and citric acid. Citric acid is a particularly useful acid component because it also imparts a certain cohesiveness or binding effect to the overall smokeless tobacco composition.

Exemplary bases of the acid/base pair include carbonate and bicarbonate materials, particularly alkali metal or alkaline earth metal salts thereof. Carbonate and bicarbonate base materials capable of use in the present invention include sodium carbonate, sodium bicarbonate, potassium carbonate, potassium bicarbonate, magnesium carbonate, calcium carbonate, sodium sesquicarbonate, sodium glycine carbonate, lysine carbonate, arginine carbonate, and mixtures thereof. The amount of base in the compositions of the invention can vary, but is typically at least about 1% by dry weight, or at least about 2% by dry weight.

The amount of total acid/base pair effervescent material in the product can vary. The amount of such material should be sufficient to contribute to the effervescence of the product when placed in the oral cavity. The amount of effervescent acid/base material (combined) is typically about 2.0 to about 20 dry weight percent, often about 2.5 to about 15 dry weight percent, and most often about 5 to about 10 dry weight percent, based on the total weight of the smokeless tobacco composition.

In certain embodiments, it is desirable for the reaction between the acid and base component to proceed completely. To ensure this result, the relevant amount of acid and base can be adjusted so that the necessary equivalent amounts are present. For example, if a diprotic acid is used, then either a di-reactive base can be used in roughly equivalent amount or a mono-reactive base could be used at a level roughly twice that of the acid. Alternatively, an excess amount of either acid or base can be used, particularly where the acid or base is intended to provide an independent effect on the organoleptic properties of the smokeless tobacco composition beyond simply providing effervescence.

A combination of carbonate and bicarbonate components can be desirable because bicarbonate materials, while highly reactive in effervescent reactions, are not efficient pH adjustment agents in the preferred product pH range. Thus, in certain embodiments utilizing both a bicarbonate and carbonate material, it is advantageous to stoichiometrically match the bicarbonate amount to the acid component of the effervescent material and use a carbonate material to raise pH. In this manner, although the carbonate material would be expected to participate in the effervescent reaction to a limited degree, the bicarbonate material is present in an amount sufficient to fully react with the available acid component and the carbonate material is present in an amount sufficient to provide the desired pH range.

The products of the invention incorporate some form of a plant of the *Nicotiana* species, and most preferably, those compositions or products incorporate some form of tobacco. The selection of the *Nicotiana* species can vary; and in particular, the selection of the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos and various blends of any of the foregoing tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Exemplary *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.×sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO 2008/103935 to Nielsen et al.

For the preparation of smokeless and smokable tobacco products, it is typical for harvested plant of the *Nicotiana* species to be subjected to a curing process. Descriptions of various types of curing processes for various types of tobaccos are set forth in *Tobacco Production, Chemistry and Technology*, Davis et al. (Eds.) (1999). Exemplary techniques and conditions for curing flue-cured tobacco are set forth in Nestor et al., *Beitrage Tabakforsch. Int.*, 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.*, 21, 305-320 (2005) and Staaf et al.,

*Beitrage Tabakforsch. Int.,* 21, 321-330 (2005), which are incorporated herein by reference. Certain types of tobaccos can be subjected to alternative types of curing processes, such as fire curing or sun curing. Preferably, harvested tobaccos that are cured are then aged. As such, tobaccos used for the preparation of tobacco compositions or products most preferably incorporate components of tobaccos that have been cured and aged.

In certain embodiments, the tobacco material is used in a form that can be described as shredded, ground, granulated, fine particulate, or powder form. The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. The tobacco material typically has an average particle size of about 10 to about 100 microns, more often about 20 to about 75 microns, and most often about 25 to about 50 microns.

In other embodiments, at least a portion of the tobacco material employed in the tobacco product can have the form of an extract. Tobacco extracts can be obtained by extracting tobacco using a solvent having an aqueous character such as distilled water or tap water. As such, aqueous tobacco extracts can be provided by extracting tobacco with water, such that water insoluble pulp material is separated from the aqueous solvent and the water soluble and dispersible tobacco components dissolved and dispersed therein.

The tobacco extract can be employed in a variety of forms. For example, the aqueous tobacco extract can be isolated in an essentially solvent free form, such as can be obtained as a result of the use of a spray drying or freeze drying process, or other similar types of processing steps. Use of a solid form of tobacco extract can be particularly advantageous because it allows a tobacco material to be combined with the effervescent material without introducing significant moisture to the gasified sugar material, which could prematurely cause release of the entrapped gas. Alternatively, the aqueous tobacco extract can be employed in a liquid form, and as such, the content of tobacco solubles within the liquid solvent can be controlled by selection of the amount of solvent employed for extraction, concentration of the liquid tobacco extract by removal of solvent, addition of solvent to dilute the liquid tobacco extract, or the like. Exemplary techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bemasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

The tobacco material can be subjected to a pasteurization treatment or other suitable heat treatment process steps. Typical pasteurization process conditions involve subjecting the tobacco material, which most preferably is in moist form, to heat treatment. The heat treatment can be carried out in an enclosed vessel (e.g., one providing for a controlled atmospheric environment, controlled atmospheric components, and a controlled atmospheric pressure), or in a vessel that is essentially open to ambient air. The heat treatment, which is provided by subjecting the tobacco material to a sufficiently high temperature for a sufficient length of time, has the ability to alter the overall character or nature of the combined material to a desired degree. For example, the heat treatment can be used to provide a desired color or visual character to the tobacco material, desired sensory properties to the tobacco material, or a desired physical nature or texture to the tobacco material. In addition, the heat treatment causes the tobacco material to experience a treatment characteristic of a pasteurization type of treatment. As such, certain types and amounts of spores, mold, microbes, bacteria, and the like can be rendered inactive, or the enzymes generated thereby can be denatured or otherwise rendered inactive. Certain components that are rendered inactive, or are otherwise effectively reduced in number, are biological agents (e.g., enzymes) that have the capability of promoting formation of tobacco-specific nitrosamines Pasteurization techniques are set forth, for example, on the websites of the U.S. Food and Drug Administration and the U.S. Department of Agriculture. Exemplary types of pasteurization equipment, methodologies and process conditions also are set forth in US Pat. Pub. Nos. 2009/0025738 to Mua et al. and 2009/0025739 to Brinkley et al., which are incorporated by reference herein. If desired, the tobacco material can be subjected to irradiation sufficient to provide the benefits of pasteurization treatment.

In one embodiment, a moist tobacco material is subjected to a heat treatment (e.g., heating the moist tobacco material at a temperature of at least about 100° C.) after mixing the tobacco material with one or more additives selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof. Such a heat treatment process is described in US Pat. Pub. No. 2010/0300463 to Chen et al., which is incorporated by reference herein.

The amount of tobacco material in the smokeless tobacco product can vary, but tobacco material is often the predominate ingredient. Exemplary weight ranges include about 2 to about 80 dry weight percent, often about 3 to about 60 dry weight percent, more often about 10 to about 40 dry weight percent. The amount of tobacco material in some embodiments can be characterized as at least about 3 dry weight percent, or at least about 10 dry weight percent, or at least about 15 dry weight percent, or at least about 20 dry weight percent. The amount of tobacco material in some embodiments can be characterized as no more than about 80 dry weight percent, no more than about 60 dry weight percent, no more than about 50 dry weight percent, or no more than about 40 dry weight percent.

Further ingredients can be admixed with, or otherwise incorporated within, the tobacco material and gasified sugar material that form the basis of the smokeless tobacco composition or formulation of the present invention. The additional components can be artificial, or can be obtained or derived from herbal or biological sources. Exemplary types of additional components include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, sugar alcohols such as isomalt, mannitol, erythritol, xylitol, or sorbitol, finely divided cellulose, CARBOPOL® polymers, vegetable fiber material such as sugarbeet fiber, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring, titanium dioxide, and the like), humectants (e.g., glycerin, propylene glycol, and the like), oral care additives (e.g., thyme oil, eucalyptus oil, and zinc), preservatives (e.g., potassium sorbate and the like), syrups (e.g., honey, high fructose corn syrup, and the like), disintegration or compressibility aids (e.g., microcrystalline cellulose, croscarmellose sodium, crospovidone, sodium starch glycolate, pregelatinized corn starch, and the like), flavorant and flavoring mixtures, lipids such as meltable fats or oils, antioxidants, and mixtures thereof. If desired, the additional components can be encapsulated as set forth in US Pat. Pub. No. 2008/0029110 to Dube et al, which is incorporated by reference herein.

The aforementioned types of components can be employed together (e.g., as mixtures) or separately (e.g., individual components can be added at different stages involved in the preparation of the final tobacco product). The relative amounts of the various components within the smokeless tobacco formulation may vary, and typically are selected so as to provide the desired sensory and performance characteristics to the tobacco product.

Representative buffers include metal carbonates and bicarbonates, mono- and di-metal phosphates, and mixtures thereof. A representative buffering agent can be composed of virtually all sodium carbonate, and another representative buffering agent can be composed of virtually all sodium bicarbonate. In certain embodiments, the buffer or pH adjusting ingredient is present in an amount of about 1 to about 15 dry weight percent, often about 5 to about 12 dry weight percent, and more often about 6 to about 10 dry weight percent. Exemplary buffered pH ranges in smokeless tobacco products include the pH range of about 6 to about 11, and often about 7 to about 10 (e.g., about 7 or about 8).

As used herein, a "flavorant" or "flavoring agent" is any flavorful or aromatic substance capable of altering the sensory characteristics associated with the smokeless tobacco composition. Exemplary sensory characteristics that can be modified by the flavorant include, taste, mouthfeel, moistness, coolness/heat, and/or fragrance/aroma. The flavorants can be natural or synthetic, and the character of these flavors can be described as, without limitation, fresh, sweet, herbal, confectionary, floral, fruity or spice. Specific types of flavors include, but are not limited to, vanilla, coffee, chocolate, cream, mint, spearmint, menthol, peppermint, wintergreen, lavender, *cardamon*, nutmeg, cinnamon, clove, cascarilla, sandalwood, honey, jasmine, ginger, anise, sage, licorice, lemon, orange, apple, peach, lime, cherry, and strawberry. Flavorants utilized in the invention also can include components that are considered moistening, cooling or smoothening agents, such as eucalyptus. These flavors may be provided neat (i.e., alone) or in a composite (e.g., spearmint and menthol or orange and cinnamon). Flavorants are typically present in an amount of about 0.5 to about 10 dry weight percent, often about 1 to about 6 dry weight percent, and most often about 2 to about 5 dry weight percent.

Sweeteners can be used in natural or artificial form or as a combination of artificial and natural sweeteners. In certain embodiments, the sweetener can include, glycyrrhizin, glycerol, inulin, lactitol, mabinlin, maltitol, mannitol, miraculin, monatin, monellin, osladin, pentadin, polydextrose, sorbitol, stevia, tagatose, thaumatin, acesulfame potassium, alitame, aspartame, cyclamate, dulcin, glucin, neotame, saccharin, sucralose, and combinations thereof. In certain embodiments, the sweetener comprises sucralose (1,6-Dichloro-1,6-dideoxy-β-D-fructofuranosyl-4-chloro-4-deoxy-α-D-galactopyranoside). The amount of sweetener is typically about 0.1 to about 10 dry weight percent, often about 0.25 to about 5 dry weight percent, and most often about 0.5 to about 4 dry weight percent, based on the total dry weight of the smokeless tobacco product.

A colorant or colorant mixture, when present, is present in an amount necessary to achieve the desired coloring of the final product. The amount of colorant is typically about 0.1 to about 10 dry weight percent, often about 0.5 to about 5 dry weight percent, and most often about 1 to about 4 dry weight percent.

The smokeless tobacco compositions of the invention will typically include at least one filler ingredient. Such components of the composition often fulfill multiple functions, such as enhancing certain organoleptic properties such as texture and mouthfeel, enhancing cohesiveness or compressibility of the product, and the like. Certain embodiments of the invention utilize combinations of filler components such as a mixture of microcrystalline cellulose, mannitol, and maltodextrin. When present, the one or more fillers are typically present in an amount of about 5 to about 60 dry weight percent, often about 10 to about 35 dry weight percent, and most often about 20 to about 30 dry weight percent. In certain embodiments, the filler component is present in any amount of at least about 3% by dry weight.

A binder component, such as povidone, can also be added to the formulation to enhance the cohesiveness of the overall formulation. Binder components can be added as a solid particulate or dissolved in a solvent. When present, a binder is typically present in an amount of about 0.5 to about 15 dry weight percent, often about 1 to about 10 dry weight percent, and most often about 2 to about 8 dry weight percent. In certain embodiments, the binder component is present in any amount of at least about 2% by dry weight.

If necessary for downstream processing of the smokeless tobacco product, such as granulation or mixing, a flow aid can also be added to the material in order to enhance flowability of the smokeless tobacco material. Exemplary flow aids include microcrystalline cellulose, polyethylene glycol, stearic acid, calcium stearate, magnesium stearate, zinc stearate, canauba wax, and combinations thereof. When present, a representative amount of flow aid may make up at least about 0.5 percent or at least about 1 percent, of the total dry weight of the formulation. Preferably, the amount of flow aid within the formulation will not exceed about 5 percent, and frequently will not exceed about 3 percent, of the total dry weight of the formulation.

In certain embodiments, the smokeless tobacco product further comprises a salt. The presence of a salt in the smokeless tobacco product may act to suppress bitterness and/or enhance sweetness. Any type of salt can be used. Common table salt (NaCl) is typically used according to the present invention, but other types of salts are intended to be encompassed as well. The amount of salt added may vary, but typically ranges from 0% to about 8%, for example from about 1% to about 4% by dry weight of the smokeless tobacco product.

The smokeless tobacco product can include a lipid component, such as, for example, a fat, oil, or wax substance (or combination thereof), in order to reduce the dissolution rate of the product in the oral cavity. A lipid component can also serve to retard the sensitivity of the gasified sugar material to the presence of water, which can improve storage and handling of the smokeless tobacco products of the invention. The lipid components used in the invention can be derived from animal or plant material and typically comprise mostly triglycerides along with lesser amounts of free fatty acids and mono- or di-glycerides. Exemplary fats that can be used include vegetable shortening, palm oil, palm kernel oil, safflower oil, soybean oil, cottonseed oil, cocoa butter, and mixtures thereof. Exemplary lipid substances include 108-24-B from AarhusKarlshamn USA Inc. (a non-hydrogenated lauric coating fat containing a blend of palm kernel oil and palm oil); PARAMOUNT X from Loders Croklaan (a partially hydrogenated vegetable oil containing a blend of palm kernel oil, soybean oil, and cottonseed oil); CB302 from Barry Callebaut (natural cocoa butter); and CEBES 21-25 from AarhusKarlshamn USA Inc. (a mixture of palm kernel oil and hydrogenated palm oil).

The relative amount of lipid substance within the smokeless tobacco composition may vary. Preferably, the amount of lipid substance within the smokeless tobacco composition is at least about 3 percent, at least about 5 percent, or at least about 7 percent, on a dry weight basis of the composition. In certain aspects, the amount of lipid material is less than about 20 percent, less than about 15 percent, or less than about 10 weight percent, on a dry weight basis. Exemplary lipid weight ranges include about 3 to about 20 dry weight percent, more typically about 5 to about 10 dry weight percent.

In one embodiment, the invention provides a smokeless tobacco product comprising about 20 to about 60 dry weight percent (e.g., about 25 to about 50 dry weight percent) of a gasified sugar material (preferably in particulate form); about 5 to about 50 dry weight percent (e.g., about 10 to about 40 dry weight percent) of a tobacco material (e.g., a particulate tobacco material or aqueous tobacco extract or combination thereof); optionally about 5 to about 40 dry weight percent of a sugar alcohol (separate from the gasified sugar material); optionally up to about 25 dry weight percent (e.g., about 5 to about 20 dry weight percent) of a filler; optionally up to about 5 dry weight percent of a binder; optionally up to about 5 dry weight percent of a sweetener; optionally up to about 5 dry weight percent of a flavorant; optionally up to about 5 dry weight percent of sodium chloride; optionally up to about 3 dry weight percent of an acid; and optionally up to about 3 dry weight percent of a base.

In another embodiment, the invention provides a smokeless tobacco product comprising about 60 to about 95 dry weight percent (e.g., about 70 to about 90 dry weight percent) of a gasified sugar alcohol; about 5 to about 30 dry weight percent (e.g., about 10 to about 20 dry weight percent) of a tobacco material (e.g., a particulate tobacco material or aqueous tobacco extract or combination thereof); optionally about 5 to about 20 dry weight percent of a sugar alcohol syrup; optionally up to about 15 dry weight percent of a lipid; optionally up to about 20 dry weight percent (e.g., about 5 to about 10 dry weight percent) of a filler; optionally up to about 5 dry weight percent of a binder; optionally up to about 5 dry weight percent of a sweetener; optionally up to about 5 dry weight percent of a flavorant; optionally up to about 5 dry weight percent of a humectant (e.g., glycerin); optionally up to about 5 dry weight percent of sodium chloride; optionally up to about 3 dry weight percent of an acid; and optionally up to about 3 dry weight percent of a base.

The manner by which the various components of the smokeless tobacco product are combined may vary. The various components of the product can be contacted, combined, or mixed together in conical-type blenders, mixing drums, ribbon blenders, or the like. As such, the overall mixture of various components may be relatively uniform in nature. See also, for example, the types of methodologies set forth in US Pat. Pub. Nos. 2005/0244521 to Strickland et al. and 2009/0293889 to Kumar et al.; each of which is incorporated herein by reference.

The smokeless tobacco products of the invention can be formed into a variety of shapes, including pills, tablets, spheres, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. Such product shapes can be formed in a variety of manners using equipment such as moving belts, nips, extruders, granulation or agglomeration devices, compaction devices, and the like. The products of the invention can also be used in powder or particulate form.

Exemplary smokeless tobacco product forms of the invention include pelletized tobacco products (e.g., compressed or molded pellets produced from powdered or processed tobacco, such as those formed into a desired shape), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, rolls of tape-like films, readily water-dissolvable or water-dispersible films or strips (see, for example, US Pat. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some form), and the like.

Shapes such as rods and cubes can be formed by first extruding the material through a die having the desired cross-section (e.g., round or square) and then optionally cutting the extruded material into desired lengths. Exemplary extrusion equipment suitable for use in the invention include industrial pasta extruders such as Model TP 200/300 available from Emiliomiti, LLC of Italy. Sheet-like materials can be prepared by applying the tobacco composition onto a moving belt and passing the moving belt through a nip formed by opposing rollers, followed by cutting the sheet into desired lengths.

In certain preferred embodiments, the smokeless tobacco product is in the form of a compressed or molded pellet, wherein the pellet can have any of a variety of shapes including traditional pill or tablet shapes. Exemplary pellet sizes include pellets having a length and width in the range of about 3 mm to about 20 mm, more typically about 5 to about 12 mm. Exemplary pellet weights range from about 250 mg to about 600 mg, more typically about 300 mg to about 450 mg. Compressed smokeless tobacco pellets can be produced by compacting granulated tobacco and associated formulation components in the form of a pellet, and optionally coating each pellet with an overcoat material. Exemplary granulation devices are available as the FL-M Series granulator equipment (e.g., FL-M-3) from Vector Corporation and as WP 120V and WP 200VN from Alexanderwerk, Inc. Exemplary compaction devices, such as compaction presses, are available as Colton 2216 and Colton 2247 from Vector Corporation and as 1200i, 2200i, 3200, 2090, 3090 and 4090 from Fette Compacting. Devices for providing outer coating layers to compacted pelletized tobacco formulations are available as CompuLab 24, CompuLab 36, Accela-Cota 48 and Accela-Cota 60 from Thomas Engineering.

In one aspect, the invention provides a method of preparing a smokeless tobacco composition of the invention by first making a tobacco-containing granulation mixture, granulating the mixture by addition of a binder solution to produce an intermediate granular product, and then blending the granules with a gasified sugar material in particulate form. The resulting composition can be compressed into a predetermined shape, such as a pellet or rod, or placed in a pouch as described above. Alternatively, the mixture of tobacco-containing granules and gasified sugar particles can be mixed with a further binder, such as a sugar alcohol syrup (e.g., maltitol syrup) and extruded into pellets, rods or other desired shapes.

The tobacco-containing granulation mixture typically includes a tobacco material (e.g., tobacco in particulate form) and one or more binders, fillers, sweeteners, salts, flavorants, colorants, compressibility aids, or other additional ingredients. The granulation mixture is typically relatively dry, meaning no liquid ingredients are introduced and instead the mixture contains essentially all dry powder ingredients. The granulation material is mixed with a binder solution (e.g., by spraying the binder solution into the granulator) and granulated to a desired particle size, such as about 100 to about 200 microns. As would be understood in the art, the binder solution facilitates agglomeration of the dry powder granulation mixture into larger granules.

The binder solution used in the granulation process can be any aqueous or alcohol-based solution containing a binding agent, particularly a polymeric binding agent such as povidone or hydroxypropylcellulose, and can contain other components including any of the components discussed herein such as tobacco material (e.g., a tobacco extract), pH adjusting materials, sweeteners, flavorants, and salts. The binder solution will typically have a solids content of about 5 to about 20 percent (w/w), and preferred solvents include water and ethanol. In some cases, the binder component of the binder solution will be a tobacco extract, particularly a highly concentrated tobacco extract (e.g., an aqueous extract having a solids content of at least about 20% or at least about 50%).

As noted above, in certain embodiments, acid/base effervescing combinations are added to the product to further enhance the effervescence effect. For example, an acid, such as citric acid, can be added to the granulation mixture and a base, such as sodium carbonate or sodium bicarbonate, can be added to the binder solution. Alternatively, the acid component is added to the binder solution and the base component is added to the granulation mixture.

Following granulation, the granules are advantageously dried, typically to a moisture level of less than about 7.0 weight percent, more typically less than about 6.5 weight percent, and often less than about 6.0 weight percent (e.g., a range of about 4.0 to about 7.0 weight percent). An exemplary moisture level is about 5.5 weight percent.

The dried granules are then blended with the remaining desired components of the smokeless tobacco product including a gasified sugar material and optionally one or more binders, fillers, sweeteners, flavorants, colorants, flow aids, or other components. The blending of the granulated material with the remaining ingredients can be accomplished using a granulator or any other mixing device. The final blended material is then optionally compressed using conventional tableting techniques. Alternatively, the blended material can be mixed with a further binder such as a sugar alcohol syrup and extruded into a desired product shape.

In an alternative granulation process, the powder component is substantially or completely free of tobacco component and instead comprises primarily non-tobacco filler materials (e.g., sugar alcohol powder, microcrystalline cellulose powder, sugarbeet fiber, and combinations thereof), such as at least about 20% by weight or at least about 30% by weight of such non-tobacco filler materials. The binder solution can contain a tobacco extract (e.g., a tobacco extract having a solids weight percentage of at least about 40%) as the primary binder component.

In an alternative process, the gasified sugar material is formed in situ within the smokeless tobacco composition. In this process, dry powder ingredients including at least one sugar material (e.g., a sugar substitute such as a sugar alcohol or mixture of sugar alcohols) are mixed and heated to form a molten, liquid material. For example, a mixture containing primarily isomalt can be heated to about 140-145° C. (at ambient pressure or under vacuum) to form a molten composition. The exact temperature of the molten composition will vary depending on the composition, but will typically be higher than the hard crack stage of the sugar material. The molten material will also typically contain a tobacco material (e.g., a particulate tobacco material or a tobacco extract) and one or more optional ingredients, such as any of those discussed herein (e.g., salts, natural sweeteners, artificial sweeteners, organic and inorganic fillers, binders, pH adjusters or buffering agents, colorants, humectants, oral care additives, preservatives, syrups, disintegration or compressibility aids, flavorant and flavoring mixtures, lipids such as meltable fats or oils, antioxidants, and mixtures thereof). While maintaining the composition in molten form (e.g., maintain the molten material at a temperature of at least about 100° C. or at least about 125° C.), a source of water is introduced into the molten composition, typically while vigorously stirring or agitating the molten material.

Contact between the water source and the molten material results in a vigorous reaction typically characterized by loud cracking noises as the molten material is quickly cooled into a crystal-like matrix. Although not bound by any particular theory of operation, it is believed that the abrupt cooling of the molten material by addition of the water source results in entrapment of various gases within the solidified crystalline matrix.

The source of water can be pure water or an aqueous solution such as a solution containing one or more pH adjusting or buffering materials (e.g., carbonate or bicarbonate salts). The source of water can be at room temperature or chilled to temperatures below room temperature. In some embodiments, the source of water is in the form of ice. An exemplary temperature range for the water source is about 0 to about 25° C. (e.g., about 0 to about 15° C.).

Mixing of the molten material components and mixing of the molten material with the source of water can occur in any suitable mixing vessel, typically using a vessel equipped for stirring or agitation and capable of applying a vacuum to the contents of the vessel. Exemplary vessels also include means to heat and insulate the contents of the vessel (e.g., a jacketed vessel). After the in situ gas entrapment process, the resulting solidified material can be subjected to various processing steps, such as filtration, cooling, drying, and the like.

The smokeless tobacco products can include an optional outer coating, which can help to improve storage stability of the smokeless tobacco products of the invention as well as improve the packaging process by reducing friability and dusting.

The coating typically comprises a film-forming polymer, such as a cellulosic polymer, an optional plasticizer, and optional flavorants, colorants, salts, sweeteners or other components of the types set forth herein. The coating compositions are usually aqueous in nature and can be applied using any pellet or tablet coating technique known in the art, such as pan coating. Exemplary film-forming polymers include cellulosic polymers such as methylcellulose, hydroxypropyl cellulose (HPC), hydroxypropyl methylcellulose (HPMC), hydroxyethyl cellulose, and carboxy methylcellulose. Exemplary plasticizers include aqueous solutions or emulsions of glyceryl monostearate and triethyl citrate.

Non-aqueous coatings can also be applied using temperature controlled pellet or tablet coating techniques known in the art. Examples of non-aqueous coatings include vegetable shortening, palm kernel oil or fat, cocoa butter, cocoa butter substitutes or replacements, plasticizers (e.g., glyceryl monostearate, triethyl citrate, glycerol, propylene glycol, polyethylene glycol), and emulsifiers (e.g., lecithin, sodium stearoyl lactylate, polysorbate 20-80), and mixtures thereof.

In one embodiment, the coating composition comprises up to about 75 weight percent of a film-forming polymer solution (e.g., about 40 to about 70 weight percent based on total weight of the coating formulation), up to about 5 weight percent of a plasticizer (e.g., about 0.5 to about 2 weight percent), up to about 5 weight percent of a sweetener (e.g., about 0.5 to about 2 weight percent), up to about 10 weight percent of one or more colorants (e.g., about 1 to about 5 weight percent), up to about 5 weight percent of one or more flavorants (e.g., about 0.5 to about 3 weight percent), up to about 2 weight percent of a salt such as NaCl (e.g., about 0.1 to about 1 weight percent), and the balance water.

To prevent premature reaction of the effervescent materials in the pellet, the rate at which the aqueous coating composition is applied to the pellet can be controlled. For example, in one embodiment, the rate at which the coating material is applied to the pellets in a pan coater is maintained at a rate less than about 55 g of coating composition/min, more typically less than about 50 g/min, for a 25 lb batch of pellets.

Following the optional coating, the smokeless product can be dried to a final desired moisture level. The moisture content of the smokeless tobacco product prior to use by a consumer can vary. Typically, the moisture content of the smokeless tobacco product, as present within a single unit of product prior to insertion into the mouth of the user, is within the rang of about 2 to about 6 weight percent (e.g., about 4 percent) based on the total weight of the product unit. Control of the final moisture of the product can be important for storage stability.

The manner by which the moisture content of the tobacco product is controlled may vary. For example, the tobacco product can be subjected to thermal or convection heating. As a specific example, the formulation may be oven-dried, in warmed air at temperatures of about 40° C. to about 95° C., with a preferred temperature range of about 60° C. to about 80° C., for a length of time appropriate to attain the desired moisture content. Alternatively, tobacco formulations may be moistened using casing drums, conditioning cylinders or drums, liquid spray apparatus, ribbon blenders, mixers available as FKM130, FKM600, FKM1200, FKM2000 and FKM3000 from Littleford Day, Inc., Plough Share types of mixer cylinders, and the like.

The acidity or alkalinity of the smokeless tobacco product, which is often characterized in terms of pH, can vary. Typically, the pH of that formulation is at least about 6.5, and preferably at least about 7.5. Typically, the pH of that formulation will not exceed about 9.5, and often will not exceed about 9.0. A representative tobacco formulation exhibits a pH of about 6.8 to about 8.8 (e.g., about 7.4 to about 8.2). A representative technique for determining the pH of a smokeless tobacco formulation involves dispersing 5 g of that formulation in 100 ml of high performance liquid chromatography water, and measuring the pH of the resulting suspension/solution (e.g., with a pH meter).

In some embodiments, the smokeless tobacco composition of the invention will be contained within a pouch or bag, although a pouch may be unnecessary for some embodiments. For example, tobacco formulations having the form of a tobacco pellet or other processed form already sized for individual use may not require containment in the form of a pouch. Instead, the pellets or other processed forms of the tobacco formulation could be simply packaged in an outer container without using a pouch to divide the tobacco formulation into individual serving sizes.

Suitable packets, pouches or containers of the type used for the manufacture of smokeless tobacco products are available under the tradenames Taboka, CatchDry, Ettan, General, Granit, Goteborgs Rape, Grovsnus White, Metropol Kaktus, Mocca Anis, Mocca Mint, Mocca Wintergreen, Kicks, Probe, Prince, Skruf, TreAnkrare, CAMEL Snus Original, CAMEL Snus Frost and CAMEL Snus Spice. The tobacco formulation may be contained in pouches and packaged, in a manner and using the types of components used for the manufacture of conventional snus types of products. The pouch or fleece provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

Descriptions of various components of snus types of products and components thereof also are set forth in U.S. Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Pat. App. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus types of products can be manufactured using equipment such as that available as SB 51-1/T, SBL 50 and SB 53-2/T from Merz Verpackungmaschinen GmbH. Snus pouches can be provided as individual pouches, or a plurality of pouches (e.g., 2, 4, 5, 10, 12, 15, 20, 25 or 30 pouches) can connected or linked together (e.g., in an end-to-end manner) such that a single pouch or individual portion can be readily removed for use from a one-piece strand or matrix of pouches.

An exemplary smokeless tobacco product 10 of the invention is set forth in FIG. 1, which depicts a pouch 12 enclosing a tobacco composition 14 (e.g., a particulate tobacco material with optional additional ingredients) having a particulate gasified sugar material 16 dispersed therein. As noted above, the smokeless tobacco products of the invention could be used in other forms, including compressed pellet or extruded sheet or rod forms.

The smokeless tobacco product can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; D592,956 to Thiellier and D594,154 to Patel et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; and U.S. patent application Ser. No. 29/342,212, filed Aug. 20, 2009, to Bailey et al.; Ser. No. 12/425,180, filed Apr. 16, 2009, to Bailey et al.; Ser. No. 12/685,819, filed Jan. 12, 2010, to Bailey et al.; and Ser. No. 12/814,015, filed Jun. 11, 2010, to Gelardi et al., which are incorporated herein by reference.

EXPERIMENTAL

Aspects of the present invention are more fully illustrated by the following examples, which are set forth to illustrate certain aspects of the present invention and are not to be construed as limiting thereof. Unless otherwise noted, all parts and percentages are on a dry weight basis.

Example 1

A smokeless tobacco composition incorporating carbon dioxide infused crystals is prepared. The composition is prepared by first forming a dry powder blend and a wet blend formulated as set forth in Table 1.

TABLE 1

| Ingredients | % w/w | g/batch |
|---|---|---|
| Dry powder blend: | | |
| Milled tobacco (<60 μm particle size) | 40.0 | 200.00 |
| Sucralose | 0.4 | 2.00 |
| Isomalt | 25.0 | 125.00 |
| Erythritol | 10.0 | 50.00 |
| Xylitol | 10.0 | 50.00 |
| Maltodextrin 10 DE | 5.9 | 29.50 |
| Mint flavor | 1.5 | 7.50 |
| Sodium chloride | 1.5 | 7.50 |
| Wet blend: | | |
| Sodium chloride | 1.5 | 7.50 |
| Plasdone ® K29/32 | 4.0 | 20.00 |
| Sodium hydroxide | 0.2 | 1.00 |
| Water | | 194.44 |
| Sub total | 100.0 | 694.44 |
| $CO_2$ infused crystals | | 252.00 |
| Total | 100.2 | 946.44 |

The composition is prepared by weighing out and mixing the dry powder blend in a mixer (e.g., a KitchenAid® mixer, model KSM5, St. Joseph, Mich.) for 5 min. at low-to medium speed (position 1-2). Sodium chloride and sodium hydroxide are dissolved in water in a beaker with stirring. Plasdone® k29/32 povidone is slowly added to the beaker mixing/stirring is continued until the povidone is completely dispersed (about 30 min). Using an atomizer, the wet blend is sprayed onto the dry powder blend in the mixer while mixing at low speed. Mixing is stopped once pea-like lumps or agglomerates are formed. Agglomerates are transferred into a forced air oven and dry for 30-45 min. at about 82° C. to about 5 to 6 weight percent moisture, and thereafter the agglomerates are cooled to ambient temperature and separated into three granulation sizes (<150 microns, 150-500 microns and >500 microns) by sieving. The 150-500 micron granules are mixed with $CO_2$ infused crystals from Raven Manufacturing, LLC (Neenah, Wis.) of a similar micron size (at a weight ratio of 2 parts granulation to 1 part crystals). The resulting product is transferred to a pouching machine manufactured by Merz Verpackungsmaschinen GmbH and 400-600 mg portions are pouched in pillow-shaped fleece pouches. When introduced into the mouth, the contents of the pouched product dissolve and yield a tingling or effervescence-like sensation.

Example 2

A second smokeless tobacco composition incorporating carbon dioxide infused crystals is prepared in a manner similar to Example 1, except the formulation of Table 2 below is utilized. Microcrystalline cellulose, sodium bicarbonate and sodium carbonate are introduced into the dry powder blend. Citric acid was introduced into the wet blend, replacing sodium hydroxide.

TABLE 2

| Ingredients | % w/w | g/batch |
|---|---|---|
| Dry powder blend: | | |
| Milled tobacco (<60 μm particle size) | 70.0 | 350.00 |
| Sucralose | 0.7 | 3.50 |
| Plasdone K29/32 | 2.0 | 10.00 |
| Microcrystalline cellulose (VIVAPUR 101) | 4.0 | 20.00 |

TABLE 2-continued

| Ingredients | % w/w | g/batch |
|---|---|---|
| Maltodextrin 10 DE | 8.9 | 44.50 |
| Sodium bicarbonate | 0.8 | 4.00 |
| Sodium carbonate | 2.6 | 13.00 |
| Mint flavor | 1.5 | 7.50 |
| Sodium chloride | 2.0 | 10.00 |
| Wet blend: | | |
| Sodium chloride | 1.5 | 7.50 |
| Plasdone ® K29/32 | 4.0 | 20.00 |
| Citric acid | 2.0 | 10.00 |
| Water | | 194.44 |
| Sub total | 100.0 | 694.44 |
| $CO_2$ infused crystals | | 489.00 |
| Total | | 1183.44 |

After granulation in the same manner as described in Example 1, granules are extruded through an extruder (e.g., MG-55 model extruder, Fuji Paudal Co. Ltd, Tokyo, Japan) into short hair-like rods using a screen die. The rods are further reshaped into spheres or beads using a marumerizer (e.g., model QJ-230-T, Fuji Paudal Co. Ltd, Tokyo, Japan). The beads are finally mixed at a 1:1 ratio with $CO_2$ crystals of a similar size before pouching. When introduced into the mouth, the contents of the pouched product dissolve and yield a tingling or effervescence-like sensation.

Example 3

A third smokeless tobacco composition incorporating carbon dioxide infused crystals is prepared in a manner similar to Example 1, except the formulation of Table 3 below is utilized. Sugarbeet fiber and calcium carbonate are used in the dry powder blend, replacing Plasdone® K29/32 and sodium carbonate, respectively. For the wet blend, Plasdone® K29/32 is replaced with concentrated tobacco extract (50% w/v).

TABLE 3

| Ingredients | % w/w | g/batch |
|---|---|---|
| Dry powder blend: | | |
| Milled tobacco (<60 μm particle size) | 23.0 | 115.00 |
| Sucralose | 0.6 | 3.00 |
| Sugarbeet fiber (Fibrex ® 575) | 5.0 | 25.00 |
| Microcrystalline cellulose (Vivapur ® 101) | 34.0 | 170.00 |
| Maltodextrin 10 DE | 10.0 | 50.00 |
| Sodium bicarbonate | 0.8 | 4.00 |
| Calcium carbonate | 3.6 | 18.00 |
| Mint flavor | 1.5 | 7.50 |
| Sodium chloride | 2.0 | 10.00 |
| Wet blend: | | |
| Sodium chloride | 1.5 | 7.50 |
| Citric acid | 2.0 | 20.00 |
| Tobacco extract (50% w/v) | 10 | 50.00 |
| Water | | 186.67 |
| Final binding aid: | | |
| Maltitol syrup (Hyster 5875) | 6.0 | 30.00 |
| Sub total | 100.0 | 696.7 |
| $CO_2$ infused crystals | | 460.00 |
| Total | | 1853.33 |

Granulation proceeds as described in Example 1. After drying granules to 6 weight percent moisture, the resulting granules are mixed at a 1:1 ratio with $CO_2$ crystals. The mixture is mixed with maltitol syrup as a binder and auger extruded, shaped, and cut into pellets, bits, cubes, cylinders, or hair-like rods. The pellets or rods are pouched as described in Example 1. When introduced into the mouth, the contents of the pouched product dissolve and yield a tingling or effervescence-like sensation.

Example 4

A similar protocol to Example 3 is followed, except that milled tobacco is replaced with erythritol powder to reduce stickiness of the final product, as observed in the pouched product of Example 3. Table 4 below gives the formulation details.

TABLE 4

| Ingredients | % w/w | g/batch |
|---|---|---|
| Dry powder blend: | | |
| Erythritol | 23.0 | 115.00 |
| Sucralose | 0.6 | 3.00 |
| Sugarbeet fiber (Fibrex ® 575) | 5.0 | 25.00 |
| Microcrystalline cellulose (Vivapur ® 101) | 34.0 | 170.00 |
| Maltodextrin 10 DE | 10.0 | 50.00 |
| Sodium bicarbonate | 0.8 | 4.00 |
| Calcium carbonate | 3.6 | 18.00 |
| Mint flavor | 1.5 | 7.50 |
| Sodium chloride | 2.0 | 10.00 |
| Wet blend: | | |
| Sodium chloride | 1.5 | 7.50 |
| Citric acid | 2.0 | 20.00 |
| Tobacco extract (50% w/v) | 10 | 50.00 |
| Water | | 167.22 |
| Final binding aid: | | |
| Maltitol syrup (Hyster 5875) | 6.0 | 30.00 |
| Sub total | 100.0 | 677.2 |
| $CO_2$ infused crystals | | 489.00 |
| Total | | 1843.44 |

When introduced into the mouth, the contents of the pouched product dissolve and yield a tingling or effervescence-like sensation.

Example 5

A smokeless tobacco composition incorporating ice crystals instead of the $CO_2$ infused crystals of Examples 1-4 is prepared. The formulation is set forth in Table 5 below.

TABLE 5

| Ingredients | % w/w | g/batch |
|---|---|---|
| Dry powder blend: | | |
| Milled tobacco (<60 μm particle size) | 15.0 | 300.00 |
| Isomalt | 60.0 | 1200.00 |
| Erythritol | 15.0 | 300.00 |
| Maltitol syrup (Hystar 5875) | 10.0 | 200.00 |
| Wet blend: | | |
| Ice crystals | | 400.00 |
| Total | 100.0 | 2400.00 |

Dry powder blend ingredients are mixed at low speed (positionl-2) using a mixer (e.g., Hobart mixer, model A-200T, Hobart Corporation, Troy, Ohio) for 5-10 min. The mixture is transferred into a jacketed stainless steel cooking vessel (e.g., Motor Master 20 K series kettle, Process Systems, Inc., Park Ridge, Ill.), equipped with a vertically inserted stirring apparatus and vacuum evacuation system. The kettle's lid is closed, and vacuum sealed, while the mixture is stirred continuously. The kettle contents are heated to a melt (liquid) at 140-145° C. (300-350° F.) and held for 10 min. at 140-145° C., with continuous stirring. The vacuum is released, and the liquid is cooled to 125-130° C. Then, ice crystals are slowly introduced into the vessel via a small opening on the lid, while the contents are vigorously mixed or stirred. Introduction of ice crystals into the vessel results in a vigorous reaction (loud continuous cracking sound). Mixing is stopped after 5-10 min., depending on reaction sound. The vessel is opened, its contents are strained, and the resulting solid crystal-like matrix dried under ambient conditions (e.g., 20-25° C. and 25-31% RH) for 30-60 min. When introduced into the mouth, the crystal-like material dissolves and yields a tingling or effervescence-like sensation.

Example 6

A similar protocol to Example 5 is followed, except that milled tobacco is replaced with 50% solids (w/v) concentrated tobacco extract. Table 6 below gives the formulation details.

TABLE 6

| Ingredients | % w/w | g/batch |
|---|---|---|
| Dry powder blend: | | |
| Tobacco extract (50% w/v) | 10.0 | 200.00 |
| Isomalt | 70.0 | 1400.00 |
| Erythritol | 10.0 | 200.00 |
| Maltitol syrup (Hystar 5875) | 10.0 | 200.00 |
| Wet blend: | | |
| Ice crystals | | 400.00 |
| Total | 100.0 | 2400.00 |

When introduced into the mouth, the crystal-like material dissolves and yields a tingling or effervescence-like sensation.

Example 7

A similar protocol to Example 6 is followed, except that ice crystals are replaced with cold or chilled water (5° C.) as the wet blend. Table 7 below gives the formulation details.

TABLE 7

| Ingredients | % w/w | g/batch |
|---|---|---|
| Dry powder blend: | | |
| Tobacco extract (50% w/v) | 10.0 | 200.00 |
| Isomalt | 70.0 | 1400.00 |
| Erythritol | 10.0 | 200.00 |
| Maltitol syrup (Hystar 5875) | 10.0 | 200.00 |
| Wet blend: | | |
| Cold or chilled water (5° C) | | 400.00 |
| Total | 100.0 | 2400.00 |

When introduced into the mouth, the crystal-like material dissolves and yields a tingling or effervescence-like sensation.

Example 8

Example 8 follows a similar protocol to Example 7, except that a sodium bicarbonate solution is used in place of chilled water. Table 8 below gives the formulation details.

TABLE 8

| Ingredients | % w/w | g/batch |
|---|---|---|
| Dry powder blend: | | |
| Tobacco extract (50% w/v) | 10.0 | 200.00 |
| Isomalt | 70.0 | 1400.00 |
| Erythritol | 10.0 | 200.00 |
| Maltitol syrup (Hystar 5875) | 7.5 | 150.00 |
| Wet blend: | | |
| Water | | 350.00 |
| Sodium bicarbonate | 2.5 | 50.00 |
| Total | 100.0 | 2350.00 |

The dry powder blend is first melted in an Autoclave oven (at 125° C., 21 psi pressure) for 30 min., before being transferred into the Motor Master kettle, to facilitate melting. After introduction into the kettle, the contents are held at 125° C. before the addition of the bicarbonate solution. When introduced into the mouth, the crystal-like material dissolves and yields a tingling or effervescence-like sensation.

Example 9

Example 9 follows a similar protocol to Example 8, except that citric acid is introduced into the dry powder blend in order to facilitate the release and entrapment of air or $CO_2$ in the final crystal matrix. Table 9 below gives the formulation details.

TABLE 9

| Ingredients | % w/w | g/batch |
|---|---|---|
| Dry powder blend: | | |
| Tobacco extract (50% w/v) | 10.0 | 200.00 |
| Isomalt | 70.0 | 1400.00 |
| Erythritol | 8.0 | 160.00 |
| Maltitol syrup (Hystar 5875) | 7.5 | 150.00 |
| Citric acid | 2.0 | 40.00 |
| Wet blend: | | |
| Water | | 350.00 |
| Sodium bicarbonate | 2.5 | 50.00 |
| Total | 100.0 | 2350.00 |

When introduced into the mouth, the crystal-like material dissolves and yields a tingling or effervescence-like sensation.

Example 10

Example 10 follows a similar protocol to Example 9, except that palm kernel fat, safflower oil and glycerin are introduced into the dry powder blend in order to reduce the dissolution rate of the final product. Table 10 below gives the formulation details.

TABLE 10

| Ingredients | % w/w | g/batch |
|---|---|---|
| Dry powder blend: | | |
| Tobacco extract (50% w/v) | 10.0 | 200.00 |
| Isomalt | 74.0 | 1480.00 |
| Citric acid | 1.5 | 30.00 |
| Palm kernel fat (CEBES ® 21-25) | 6.0 | 120.00 |
| Safflower oil | 3.0 | 60.00 |
| Glycerin | 3.0 | 60.00 |
| Wet blend: | | |
| Water | | 350.00 |
| Sodium bicarbonate | 2.5 | 50.00 |
| Total | 100.0 | 2350.00 |

When introduced into the mouth, the crystal-like material dissolves and yields a tingling or effervescence-like sensation.

Example 11

Example 11 follows a similar protocol to Example 10, except that palm kernel fat and safflower oil are replaced with cocoa butter/fat and a vegetable shortening, respectively. Table 11 below gives the formulation details.

TABLE 11

| Ingredients | % w/w | g/batch |
|---|---|---|
| Dry powder blend: | | |
| Tobacco extract (50% w/v) | 10.0 | 200.00 |
| Isomalt | 74.0 | 1480.00 |
| Citric acid | 1.5 | 30.00 |
| Cocoa butter (CB 302) | 6.0 | 120.00 |
| Vegetable shortening (Confecto No stick N ™) | 3.0 | 60.00 |
| Glycerin | 3.0 | 60.00 |
| Wet blend: | | |
| Water | | 350.00 |
| Sodium bicarbonate | 2.5 | 50.00 |
| Total | 100.0 | 2350.00 |

When introduced into the mouth, the crystal-like material dissolves and yields a tingling or effervescence-like sensation.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A method of preparing a smokeless tobacco composition adapted for introduction into the oral cavity, the method comprising:

(i) mixing a tobacco material with an effervescent material capable of causing effervescence in the oral cavity, the effervescent material comprising a gasified sugar alcohol material containing an entrapped gaseous component, such that release of the entrapped gaseous component occurs upon dissolution of the gasified sugar alcohol material in the oral cavity, wherein the gasified sugar alcohol material comprises a sugar alcohol selected from the group consisting of erythritol, isomalt, and mixtures thereof, and wherein the mixing a tobacco material with an effervescent material step comprises forming the gasified sugar alcohol material in situ by mixing a water source with a molten composition comprising the tobacco material and the sugar alcohol; and (ii) incorporating the mixture formed in step (i) into a smokeless tobacco product.

2. The method of claim 1, wherein the molten composition further comprises one or more of a sugar alcohol syrup, a humectant, and a lipid.

3. The method of claim 1, wherein the water source is at a temperature of about 0 to about 25° C.

4. The method of claim 3, wherein the water source is ice or chilled water at a temperature of no more than about 15° C.

5. The method of claim 1, wherein at least one of the molten composition and the water source comprises an acid, a base, or a combination thereof.

6. The method of claim 5, wherein the molten composition comprises an acid and the water source comprises a base.

7. The method of claim 1, wherein the smokeless tobacco composition is compressed or extruded into a predetermined shape.

8. The method of claim 1, wherein the mixture is in a particulate form, and the method further comprises loading the mixture into a pouch.

9. The method of claim 1, wherein the sugar alcohol is present in an amount of at least about 50 dry weight percent, based on the total weight of the smokeless tobacco composition.

10. The method of claim 1, wherein the tobacco material is a particulate tobacco material or an aqueous tobacco extract in freeze-dried or spray-dried form.

* * * * *